United States Patent [19]

Salomon

[11] 4,418,937

[45] Dec. 6, 1983

[54] LATCHING APPARATUS FOR USE WITH SKI BINDING

[75] Inventor: Georges P. J. Salomon, Annecy, France

[73] Assignee: Etablissements Francois Salomon et Fils, S.A., Annecy, France

[21] Appl. No.: 210,222

[22] Filed: Nov. 25, 1980

[30] Foreign Application Priority Data

Nov. 28, 1979 [FR] France ..... 79 29807

[51] Int. Cl.[3] ..... A63C 9/08

[52] U.S. Cl. ..... 280/613; 280/624; 280/626; 280/628; 280/634

[58] Field of Search ..... 280/611, 613, 616, 617, 280/618, 623, 624, 625, 626, 628, 629, 631, 632, 633, 634

[56] References Cited

U.S. PATENT DOCUMENTS

| | | | |
|---|---|---|---|
| 2,854,242 | 9/1958 | Pratt | 280/628 |
| 3,596,920 | 8/1971 | Haire | 280/628 |
| 3,612,559 | 10/1971 | Petersen | 280/628 |
| 3,689,095 | 9/1972 | Salomon | 280/628 |
| 3,870,326 | 3/1975 | Cubberley | 280/628 |
| 4,196,920 | 4/1980 | Salomon | 280/613 |

FOREIGN PATENT DOCUMENTS

| | | | |
|---|---|---|---|
| 2300531 | 7/1974 | Fed. Rep. of Germany | 280/628 |
| 1045717 | 12/1953 | France . | |
| 1554728 | 1/1969 | France . | |
| 2055150 | 5/1971 | France . | |
| 2401675 | 3/1979 | France . | |
| 492463 | 8/1970 | Switzerland . | |

*Primary Examiner*—Joseph F. Peters, Jr.
*Assistant Examiner*—Kenneth R. Rice
*Attorney, Agent, or Firm*—Sandler & Greenblum

[57] ABSTRACT

A latching apparatus for use with a ski binding. The apparatus has a latching element adapted to pivot multidirectionally upon the application of an external force. Elastic elements are provided to bias the latching element and to allow for its multidirectional pivoting. The inventive apparatus makes it possible to achieve increased vertical-to-lateral release thresholds having a ratio of greater than 2:1.

44 Claims, 25 Drawing Figures

LATCHING APPARATUS FOR USE WITH SKI BINDING

BACKGROUND OF THE INVENTION

1. Field of the Invention

The present invention relates to a latching apparatus for safety bindings used for binding ski boots to skis and more particularly for bindings which may be activated multidirectionally.

2. Description of Prior Art

Numerous devices have been proposed for securing boots to skis in order to increase the safety of the skier in the event of a fall. These devices result in automatic release under the effect of a force exceeding a certain threshold in the vertical direction (frontward fall) or in the lateral direction such as occurs when the foot is twisted. Often the latching elements provided to respond to each of these forces are distinct from one another and function independently depending upon the type and direction of force exerted. The use of separate devices makes it difficult, if not impossible, to respond to forces of different types which are exerted in combination, as often occurs.

Furthermore, although latching devices which function independently of the type of force exerted, i.e., of one type or another, have been developed but also suffer from the above disadvantage.

Another problem occurs by virtue of the fact that the leg of the skier reacts mechanically in a different fashion to a flexion force such as occurs in a frontwards fall than to a torsional or twisting force caused by a lateral force or twist. The safety threshold is thus different in the two cases and this difference must be taken into account to avoid premature release without nevertheless reducing the safety of the binding in the case of a strong force. Thus, it is accepted that a ratio of 2:1 between the vertical release force and the lateral release threshold force results in a definite improvement and tests have even shown that it is preferable to attempt to achieve a ratio of 4:1.

French Pat. No. 1,045,717 proposes a device which attempts to partially resolve the problems referred to above. The device comprises a latching finger whose one end cooperates with a seating integral with the ski boot or shoe. This finger can, as a result of the force transmitted by the shoe, pivot against the return force of an adjustable spring in an opening provided in the wall of a casing integral with the ski. At a given rocking amplitude the finger leaves the seating which in turn frees the boot. A release threshold is achieved in this device by means of a rectangular base integral with the finger and rests in a locking fashion along one of its sides on the internal surface of the wall of the container. One thus obtains for the action of the spring a lever arm which is greater in cases of vertical release wherein a small side of the rectangle serves as the pivoting axis as opposed to lateral release wherein the large side of the rectangle comes into play. Although this device constitutes an improvement, it is entirely inadequate to respond to a combined force having vertical and horizontal components.

French Pat. No. 1,554,728 attempts to provide a device which responds to this type of combined force. The device is similar to the one discussed, however the base of the finger resting on the internal surface of the container is generally cylindrical. The force exerted against the return spring results in a rocking or pivoting whose amplitude is independent of the direction of the force exerted by the boot on the finger because the lever arm is independent of this direction. The safety device, therefore, responds to any force, whatever the direction, but makes it impossible to resolve the problem of obtaining a greater than 1:1 ratio as between the vertical and lateral release thresholds. To obtain a ratio approaching 2:1 is however possible by a modification which comprises fixing the boot to the ski by two identical devices. One of the devices cooperates with the front of the boot while the other cooperates with the heel of the boot. This arrangement increases the complexity of the assembly and renders adjustment of the assembly delicate.

SUMMARY OF THE INVENTION

It is, therefore, an object of the invention to resolve the above problems by providing a latching device for latching the boot to the ski which allows for automatic release whatever the direction of the force exerted; even if it is the resultant force of vertical and axial components.

It is a further object of the invention that the ratio between the vertical and lateral release thresholds be at least equal to 2:1.

According to the invention, a latching apparatus is provided for use with a ski binding. The apparatus comprises a latching element adapted to pivot multidirectionally upon the application of an external force. The latching element comprises a shoulder. Elastic means are provided which are adapted to bias the latching element to allow for the multidirectional pivoting thereof. Additionally, the apparatus includes support means adapted to support the shoulder with at least a portion of the latching element extending through the support means. The elastic means comprises at least two spring means, each of which is positioned on opposite sides of a plane of symmetry extending through the latching apparatus. The support means are positioned on opposite sides of the casing.

According to a preferred embodiment of the invention, the elastic means is mounted within a casing which comprises the above support means as well as another support means.

According to one embodiment of the invention, the spring means is maintained in compression, while according to another embodiment, the spring is maintained in tension.

In one embodiment of the invention, the apparatus may comprise an axially movable and pivotable pressure element positioned between the spring means and the latching element such that the spring means press against the latching element. The latching element comprises a base beneath the shoulder of the latching element such that the pressure element is adapted to contact and pivot relative to the base. The pressure element may comprise at least one pressure projection and, in this embodiment, the base may comprise a section adapted to cooperate with the pressure projection. The section of the base adapted to cooperate with the pressure projection may assume the form of a socket configured to receive the pressure projection. As will be shown below, the tip of the pressure projection may be substantially hemispherical, while the socket of the base section has a substantially hemispherical recess.

According to another embodiment of the invention, the pressure projection has a generally parallelpipedic cross-section, and ends in a semicylindrically shaped tip having a substantially vertical or horizontal longitudinal axis.

The pressure element may further comprise a positioning bead on the surface of the pressure projection while the base section comprises a socket configured such that the bead seats within the socket. In this embodiment, the latching elements pivots radially along the semicylindrical pressure projection of the pressure element in response to a lateral force of the latching element pivots along an upper edge of the pressure projection in response to a vertical force.

According to another embodiment of the invention, the latching element may comprise a base which includes the shoulder and a disk integrally mounted beneath the base. In this embodiment, each of the compression springs is positioned to act directly on the disk. Also, the compression springs are positioned along a plane which is itself located above the horizontal axis of the latching element. The base as well as the shoulder are positioned on the interior of the casing.

According to another embodiment of the invention, the base and shoulder are positioned on the exterior of the casing. In this embodiment, the latching element further comprises a base integral with the shoulder and a disk. Each of the spring means is in traction and is positioned to pull on the disk. The apparatus further comprises an intermediate portion between the base and the disk which extends through the casing. This intermediate portion has a tapering cross-section which widens towards the base but having a smaller cross-section than the base. First and second support means are positioned on opposite sides of the casing whereby the base is held against the first support means by means of the traction springs. The first support means is an end wall of the casing and the intermediate portion extends through a hole in the end wall. The intermediate portion has a cross-section which increases to equal the cross-section of the hole on the exterior of the casing. The hole itself has a tapering cross-section which increases towards the interior of the casing. In this embodiment, the longitudinal axis of the traction springs lie in a plane positioned beneath the horizontal plane of the horizontal or longitudinal axis of the latching element when the base rests against the end wall. A terminal portion is mounted on the base.

The latching element itself is a surface of revolution which results from the revolution of a generatrix. The intermediate portion has a configuration described by the rotation of an arc of a circle in a radial plane having a radius equal to the diameter of the shoulder less the thickness of the shoulder around a point at the edge of the shoulder in the same radial plane.

The apparatus casing may be part of a block which is adapted to be secured to a ski. The terminal portion of the latching element may be seated in a retention notch associated with the ski boot to be mounted on the ski.

Although in one embodiment of the invention the retention notch is provided in the boot itself, this retention notch may be provided in a unit such as a plate associated with the boot. According to one embodiment, the retention notch may be provided in a hollow provided in the base of the ski boot. The retention notch comprises insertion ramps facilitating release as a result of the pivoting motion of the latching element.

According to another embodiment of the invention, the retention notch may be provided on a unit in the form of a head. The head may be Cardan-mounted on a ski. In this embodiment, the head can pivot in a vertical plane.

According to another embodiment, the latching element itself ends in a U-shaped element integrally associated with a head adapted to secure the boot to the ski. Furthermore, the head may be integrally secured to the U-shaped element by screw means which allow for the elevational adjustment of the head relative to the ski.

Using the device of the invention, a differential pivoting threshold of the vertical release threshold relative to the lateral release threshold of at least 2:1 can be achieved.

BRIEF DESCRIPTION OF THE DRAWINGS

The invention will be better understood with reference to the annexed drawings, given by way of example, in which:

FIG. 1 is a transverse cross-sectional view while FIG. 2 is a top planar view (the boot being illustrated in dashed line);

DESCRIPTION OF PREFERRED EMBODIMENTS

The latching device according to the invention is of the type having a latching finger or element cooperating with a boot which is movable in that it pivots relative to a support plate integral with the ski against an elastic system comprising at least two parallel identical springs positioned symmetrically with respect to the vertical median plane of the ski.

Figure 1:
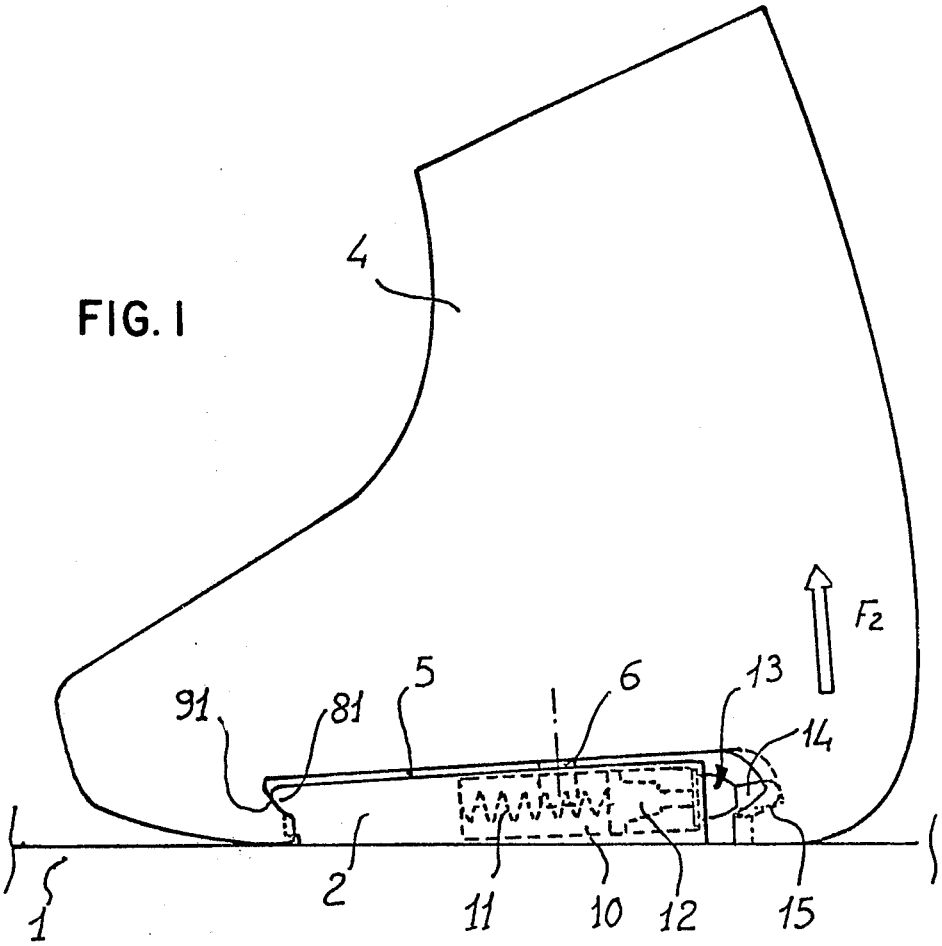
FIGS. 1 and 2 schematically illustrate the use of a device according to the invention for a safety binding of the boot binding type, i.e., where the binding is lodged in a cavity provided within the boot.
Figure 2:
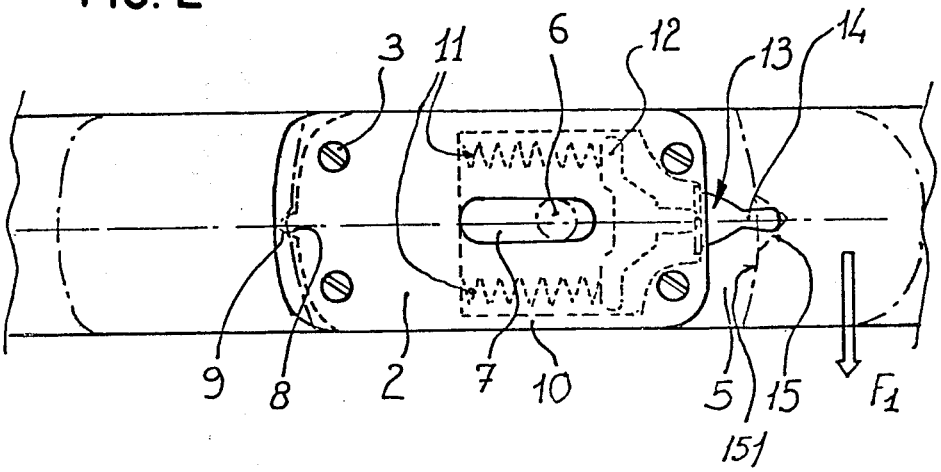

The central portion of the ski 1 is illustrated in FIGS. 1 and 2. A binding block 2 is attached to the central ski portion by means of screws 3, for example. The block 2 is positioned in a hollowed portion 5 of a boot 4. The boot 4 has a pivot 6 which is positioned in an oblong guide slot 7 provided in the lock 2. The pivot 6 forms the axis of rotation of the boot 4 with respect to the ski 1 in the case of a torsional force resulting from a lateral torsional bias shown by means of the arrow F1 (FIG. 2). The binding block 2 has at its front end at least one projection 8 which cooperates with at least one complementary female section 9 provided in the front wall of the hollowed portion 5 of the boot 4. This assures the positioning and the correct maintenance under torsion of the front of the boot 4 with respect to the ski 1. Furthermore, front vertical maintenance is assured by means of the edge 81 of the block 2 which cooperates with the hollowed out surface 91 of the boot 1. The block 2 assumes the form, on the side opposite to the projection 8, of a casing 10 casing an elastic system 11 defined by two springs acting on a pressure element or swingle bar 12 which exerts a contact pressure against the base of a latching finger element 13 extending through the rear face of the casing 10 and projecting to the exterior thereof. The finger 13, can, as shown, have a general nipple shape ending in a nipple 14 cooperating with a retention notch 15 provided in the rear wall of the opening 5 of the boot. The tip of the nipple normally rests against the surface of the retention notch 15. The notch 15 furthermore has insertion ramps 151 which facilitate the insertion of the boot 4 which surrounds the binding block 2. The boot 4 is thus perfectly secured to the block 2 by the projection 8 and the nipple 14 more or less blocking the boot 4 as long as a bias having a force sufficient to rock the finger 13 against the resistance exerted by the elastic system 11 by means of the pressure element or swingle bar 12 is not applied. Such a bias may have any direction and may be resolved into its two components: a horizontal component shown by the arrow F1 and a vertical component shown by the arrow F2. Elements 10–14 thus constitute a multidirectional latching device which will be described in detail with reference to FIGS. 3–5 and whose operation will be illustrated in FIGS. 6–8.

Figure 3:
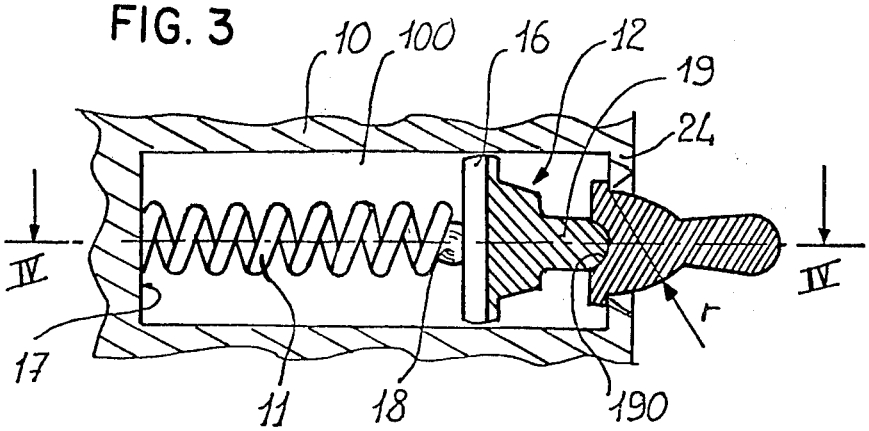
FIGS. 3 and 4 respectively illustrate a cross-sectional view along the plane III—III (FIG. 4) and along the plane IV—IV (FIG. 3), of a first embodiment of a latching device according to the invention.
Figure 4:
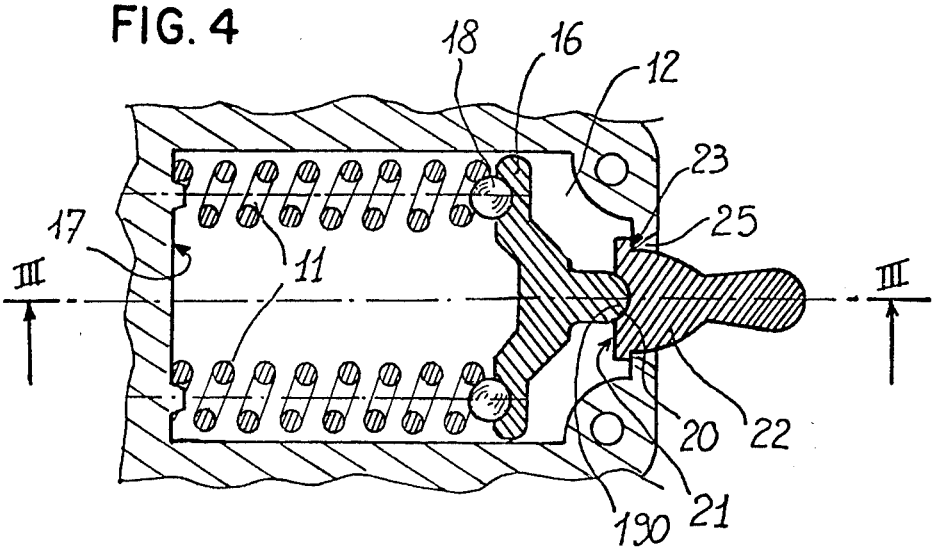
Figure 5:
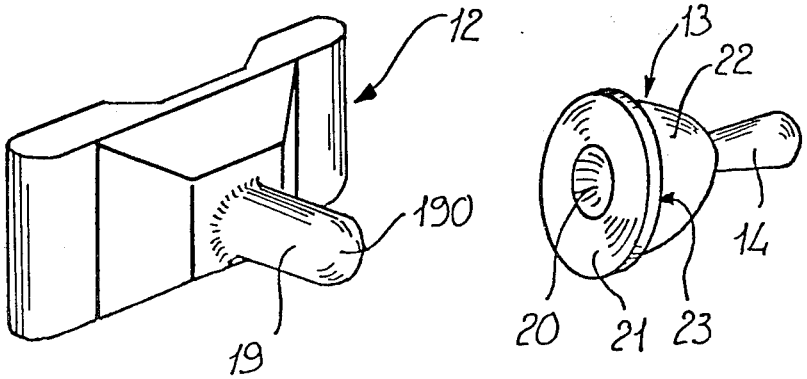
FIG. 5 illustrates the forms which the inventive pressure element or swingle bar and a latching finger may assume.

In the embodiment illustrated in FIGS. 3–5, the casing 10 has a parallelpipedic container 100 in which the pressure element 12 is movable and is guided so as to be able to pivot at a sufficient angle and on the base 16 of which the pressure force of the elastic system 11 is exerted. The elastic system rests at its other end on a support means in the form of end 17 of the casing 10. The system 11 is shown as having two coil springs 11 working in compression, however it is quite clear that any equivalent spring means may be utilized which performs the same function to achieve the necessary result. Thus, as used in the specification the terms "spring" and "spring means" are taken to include all equivalent means operating to provide the desired result. The springs 11 are maintained laterally straight in a conventional fashion in front of their support on the end 17. They exert a force on the base 16 of the pressure element 12 by means, for example, of bearings 18 cooperating with cutouts provided in the base 16 to avoid distortions. Pressure element 12 has, on the side opposite its base 16, a protuberance or pressure projection 19 which is preferably of cylindrical cross section or surface of revolution and comprises a hemispherical end or tip 190 as shown in FIGS. 3–5. However, other shapes are possible as will be seen below. This pressure projection 19 rests in a cutout or socket 20 provided in the base section 21 of the latching finger or element 13. This finger 13 is constituted by this base section 21, which is preferably otherwise planar, with which is integral an intermediate body portion 22 whose cross-section is less than that of the base 21 so as to form a shoulder 23 and decreases in the direction away from the base 21 in a manner which will be more fully explained below, itself ending in a nipple 14 which lodges itself in the hollow or notch 15 of the boot 4 as explained previously. The finger element 13 extends axially through the end wall 24 of the casing 10 through an opening 25 and tapers towards the exterior. This opening 25 has, flush with the internal surface of the end wall 24, the same dimensions as the base of the intermediate body portion 22, such that the finger 13 is guided and maintained against any displacement in a direction normal to the axis of the assembly and such that the shoulder 23 of the base 21 rests against the internal surface of the end wall 24. Preferably, all the elements including the pressure projection 19, the finger element 13 and the opening 25 are formed by the revolution of a generatrix around an axis of the deivce in the inactive position and the surface of the intermediate body 22 of the finger 13, as shown in FIG. 4, is the surface obtained by the revolution of an arc of a circle having a radius r equal to the diameter of the shoulder 23 of the base 21 of the finger 13 diminished by the width of this shoulder having as a center the edge point of the shoulder 23 situated in the same axial plane as the arc. According to this arrangement, during the pivoting or rocking during operation of the finger 13, pivoting will occur around a contact point between the shoulder 23 and the internal surface of the casing 10, and the finger element 13 will be guided by the opposite edge of the hole or opening 25 in the same axial plane.

In the above discussion reference was made to a casing 10, however it is obvious that any other arrangement allowing for two support means at different positions 17 and 24 is equivalent to the "casing" and the term "casing" as used throughout the specification is taken to include any device of this type such as, for example, that which appears in French Pat. No. 1,045,717 previously discussed.

Figure 6:
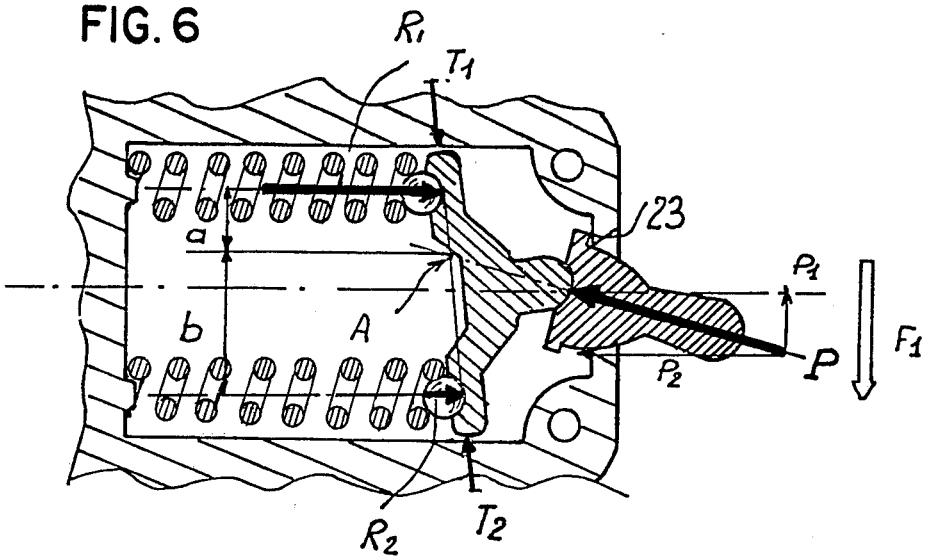
FIGS. 6 and 7 illustrate the operation of the device shown in FIGS. 3 and 4 and correspond respectively to these figures in the case of a lateral force F1 (FIG. 2) and a vertical force F2 (FIG. 1)
Figure 7:
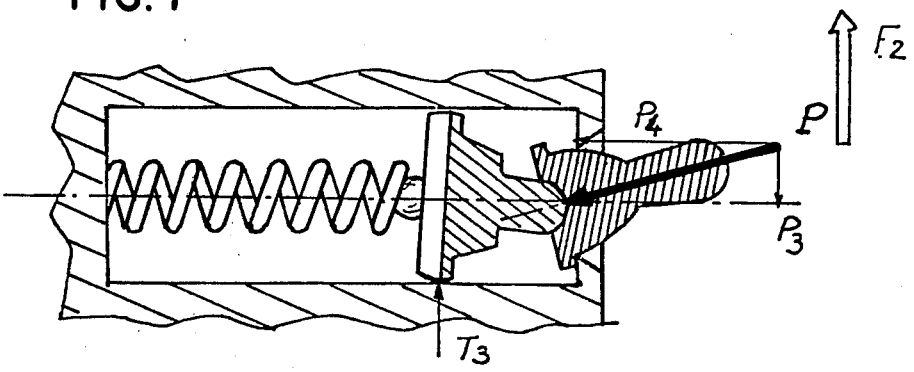
Figure 8:
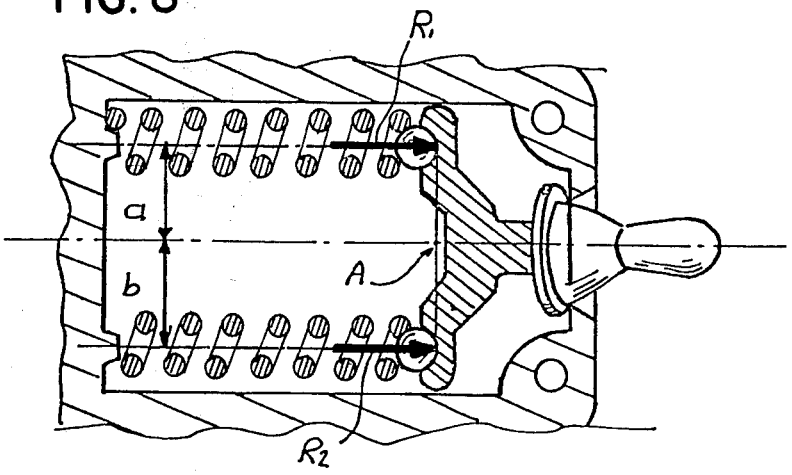
FIG. 8 is a partial cross-sectional top view corresponding to FIG. 7.

The operation of the device which has just been described, will now be explained with reference to FIGS. 6–8.

Under the effect of a force exerted by the boot on the tip of nipple 14, the finger element 13 will pivot around the support point of the shoulder 23 (as was explained above) on the end wall against the resistance of the elastic system 11 exerted on the pressure element 12. During a lateral bias such as is illustrated in FIG. 6, when considering the equilibrium of the pressure element 12, it will be noted that the pressure element is subjected to the force P of the finger 13 when viewed in horizontal projection. This force P has two components: P1 which is a transverse component; and a longitudinal component P2. The pressure element is further subjected to the forces R1 and R2 of the springs 11 as well as the forces T1 and T2 exerted by the walls of the container on the pressure element. The equilibrium of these forces does not pose a problem. R1 and R2 are essentially opposite to P2, while T1 and T2 are essentially opposite to P1. In the diagram, T2 is shown as 0. If, on the other hand, one describes the equilibrium of the moments with respect to the point A which is the intersection of the axis of the latching finger element 13 with the vertical plane containing T1 and T2, the moments of P and of T1 and T2 are 0 and R1*a*–R2*b* remains equal to 0 with a and b being respectively the distances between the axes of the springs and the point A. By virtue of the rocking or pivoting of the finger 13, b is greater than a and R1 is, therefore, greater than R2, which means that it is particularly the corresponding spring R1 which is biased. This is because P1 which is the lateral release component is greater when the axial release threshold is reached (when the tip of nipple 14 leaves retention notch 15). One can thus practically state that only one of the springs 11 is biased which in effect biases the pressure element 12 as shown in FIG. 6.

In the case of a vertical force F2 on the nipple 14, it will be noted that the components P3 and P4 of the pressure P are respectively opposite to the reaction force T3 of the container 10 on the pressure element 12 and to R1+R2. There will be no lateral pivoting of the finger 13 and the equilibrium condition in horizontal projection R1*a*–R2*d*=0 means that R1=R2 because a=b, i.e., that the two springs 11 will be subjected to identical compressions. FIG. 8 illustrates this condition in top view.

It is thus seen that the two springs are compressed in purely vertical release and, in the extreme, only one of the springs is compressed in lateral release. One thus reliably obtains, at the limit, a ratio of 2:1 between the release forces for a combined stress having vertical and lateral components; the threshold being situated between the two extremes which have just been described.

The above results can be improved to increase the ratio. Thus, one can modify the form of the insertion ramps associated with the retention notch 15 of the boot 4.

Figure 18:
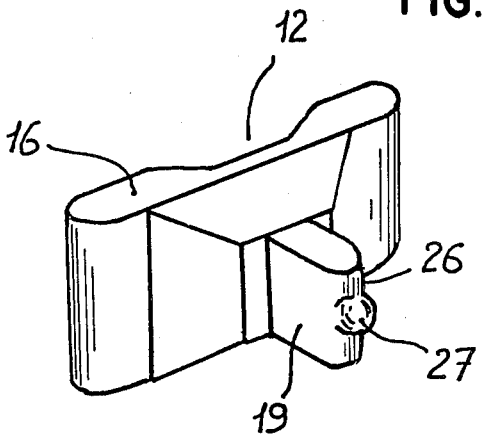
FIGS. 18–20 illustrate a preferred swingle bar or pressure element of the latching device corresponding to that shown previously respectively in FIGS. 5, 3, and 17.
Figure 18:
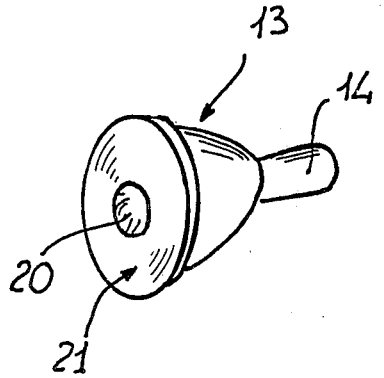
Figure 19:
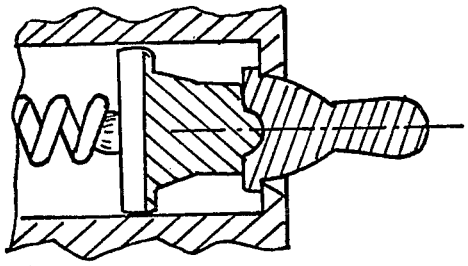
Figure 20:
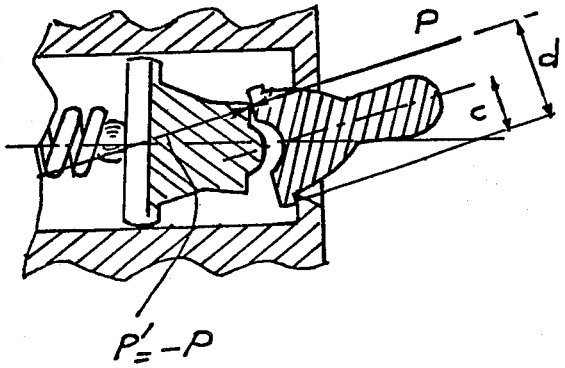
Figure 21:
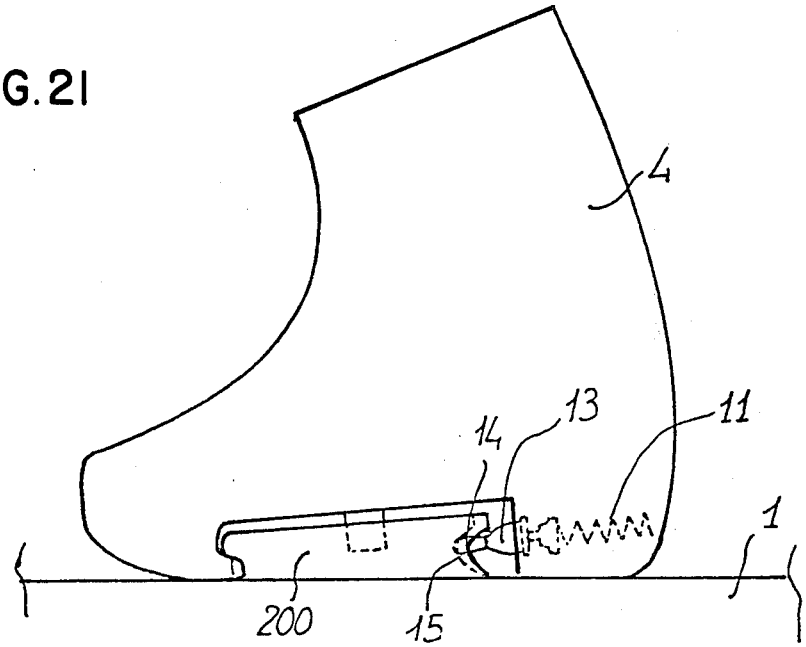
FIG. 21 is a schematic representation of an embodiment of an alternative to that of FIG. 1.

One can also modify the configuration of the support between the pressure projection 19 and the latching finger 13 as illustrated in FIGS. 18–20.

In this instance, the pressure projection 19 is in the form of a parallelpipedic element ending in a semicylindrical portion 26 having a vertical axis and which ends in a pressure bearing or ball 27. Under lateral stress, the ball 27 plays the same role as the end or tip of the projection 19 in the preceding case and the system operates in the same fashion. However, it is preferable to dimension the ball 27 so as to cooperate with the hollow space or socket 20 of the base 21 of the finger 13 to assure the correct positioning of the device in the inactive position (FIG. 19) as well as to assure the proper return to this position after stress has been applied. Under lateral stress, the latching element or finger is activated by the action of the ball or bearing 27 on the socket 20. Thus, the lever arm of the force of the pressure element P′ on the finger will be "c". Conversely, under vertical stress it is the upper end of the semi-cylindrical portion 26 which, in the operating position will serve as a support for the base 21 of the finger 13 as shown in FIG. 20. In this instance, the lever arm of the pressure P′ exerted on the finger 13 by the tallonier 12 will be d and no longer c which was the lever arm in the preceding case (FIG. 7). It is seen that d is slightly less than double c, and that the gain thus obtained is very substantial and with the result that it is necessary to apply a greater stress (in a ratio of d/c) to the springs 11 to obtain the release.

According to the situation and the conditions desired, the device may assume other configurations with respect to the projection 19 of the pressure element 12 and for the latching finger 13. Thus, FIGS. 12–16, by way of example only, show some of the possible alternatives.

Figure 12:
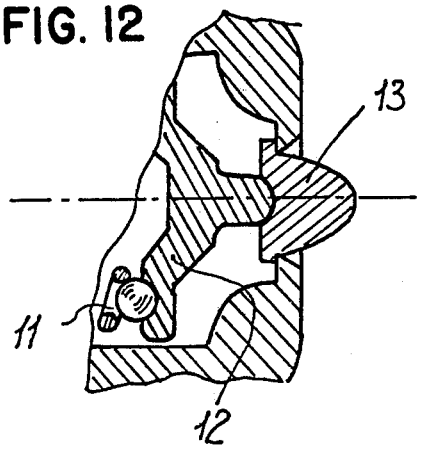
FIGS. 12–16 illustrate in partial cross-section and in the perspective various configurations which may be adopted for the pressure element and the latching finger element.

In FIG. 12, the latching finger 13 does not comprise an end nipple 14 mounted on an intermediate portion, but rather only a rounded end portion or nipple cooperating with the socket 15 whose shape can be correspondingly modified.

Figure 13:
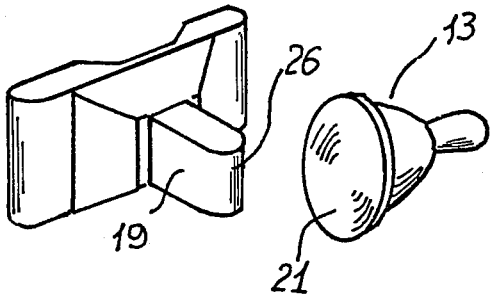

FIG. 13 illustrates a pressure element 12 whose projection 19 is parallelpipedic and ends simply in a semicylindrical surface 26 having a vertical axis which will cooperate with the planar surface of the base 21 of the finger 13 in which no hollowed space or socket is provided.

Figure 14:
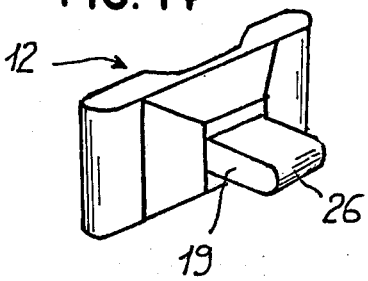

In FIG. 14, a similarly shaped pressure element 12 is illustrated in which the parallelpipedic projection 19 has a generally horizontal orientation, as does the semicylindrical end or tip portion 26.

Figure 15:
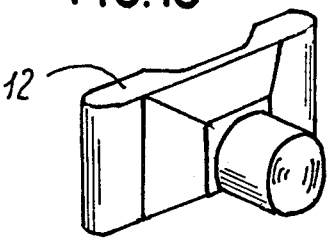

FIG. 15 illustrates another alternative embodiment wherein the pressure projection has a flattened tip which can be associated with for example a finger element 13 of the type shown in FIG. 13.

Figure 16:
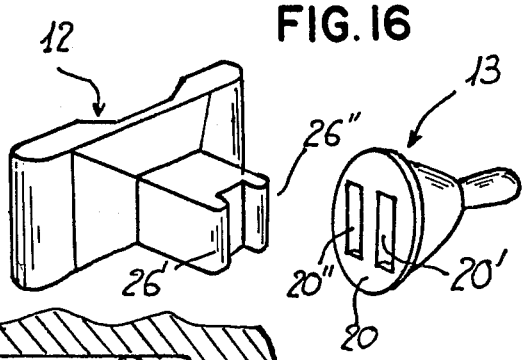

FIG. 16 illustrates another pressure element pair 12 and finger 13 in which two semicylindrical surfaces 26′ and 26″ cooperate with two hollow portions or sockets 20′ and 20″ having a complimentary shape provided in the base section 21 of the finger element 13.

Figure 17:
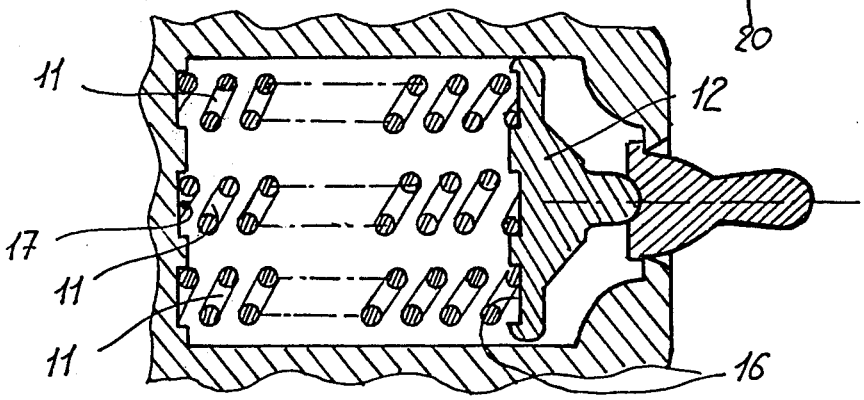
FIG. 17 illustrates a top cross-sectional view of an embodiment which may be used for an elastic system according to the invention.

The above discussion relates to an embodiment of the system in which the elastic system 11 comprises two springs having identical characteristics mounted in parallel. It is clear that the ratio between the vertical and lateral release threshold stresses can be further increased by relaying upon an elastic system comprising more than two springs 11. In practice, the number of springs possible is limited only by the space available in the casing 10. Thus, FIG. 17 illustrates the situation in which three springs 11 are mounted in parallel between the end 17 of the casing 10 and the base 16 of the pressure element 12 to which one provides an appropriate shape. There can thus be four springs positioned side by side.

The latching device according to the invention which has been described above in the preferred alternative modes has been described with reference to a use where the means for securing the boot to the ski is of the boot binding "type". It is quite clear that the latching device can also be used in other types of safety bindings. Thus, FIGS. 9–11 illustrate these other non-limiting embodiments in which the system may be used.

Figure 9:
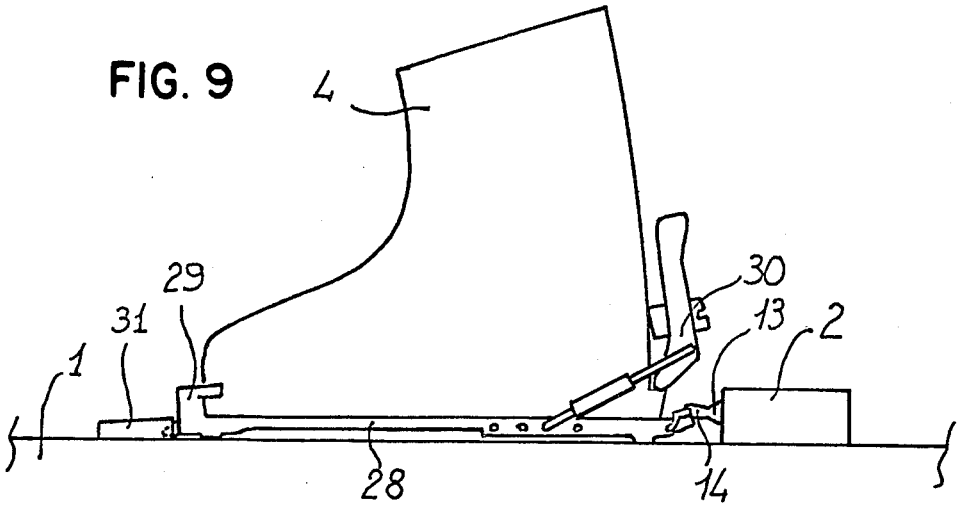
FIGS. 9–11 schematically illustrates the use of the latching devices according to the invention in the cases respectively of bindings of the heel plate type and front rim type.

FIG. 9 relates to what is known as a plate binding. This system will not be described in detail but attention is directed to the boot 4 which is secured in a conventional fashion to a plate 28 known as the release plate by a front holding element 29 and a rear holding element 30. A front retention block 31 cooperating with the front end of the plate 28 and a latching block 2 are attached to the ski 1. The latching block 2 is identical to the front retention block 31 except that it is positioned in reverse to that of FIG. 1. The block 2 encloses a latching device according to the invention with its finger element 13 whose nipple 14 cooperates with a retention notch provided on the rear of the plate 28. It should be noted that the latching could just as well be situated only in the front instead of the front block 31 or that one can utilize two of the inventive latching apparatus, one in front and one in the rear.

Figure 10:
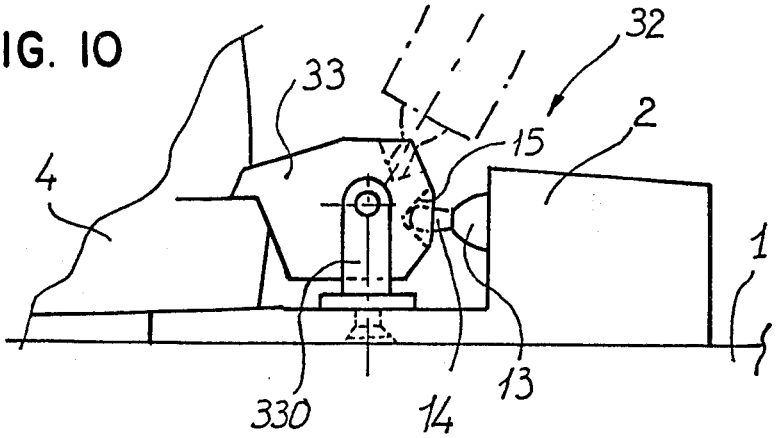

FIG. 10 illustrates a heel-type safety binding. The heel 32 is attached to the ski 1 and comprises a head 33 mounted on a universal mounting or Cardan-type device 330. The heel is adapted to pivot around a vertical and a horizontal axis. The head 33 blocks and maintains the heel of the boot 4. An attachment block 2 comprising a latching system according to the invention is attached to the ski 1 and, as shown, it can be extended into a seat serving to directly support the heel 32. The finger element 13 with its tip of nipple 14 cooperates with a retention notch 15 provided in the rear of the head 33. The latching device can, as necessary, and without complication, be positioned obliquely on the jaw 33 as is shown in dashed lines in the drawing.

Figure 11:
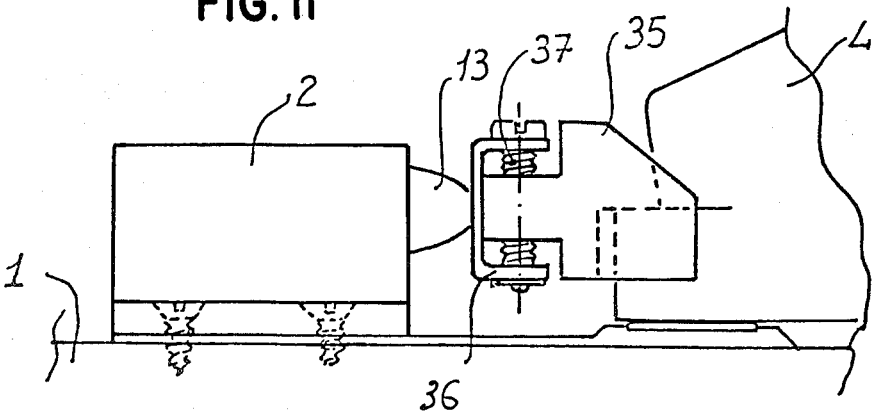

FIG. 11 illustrates another embodiment of the latching device. In this embodiment, the front of the boot 4 is maintained by a head 35 of the type which is commonly known and renders the finger 13 integral with the latching device held in the block 2 attached on the ski 1. For this purpose, instead of a nipple 14, the finger 13 ends in a U-shaped element 36 between the arms of which a projection of the head 35 is blocked by means of screw 37 which makes it possible to adjust the elevation of the head 35 from the ski. In this case, the finger 13 extending into the head is a female element on which the force of the male element which constitutes the end of the boot 4 is exerted. The operation of the latching device is otherwise identical to that described above and need not be further described at this point.

Figure 22:
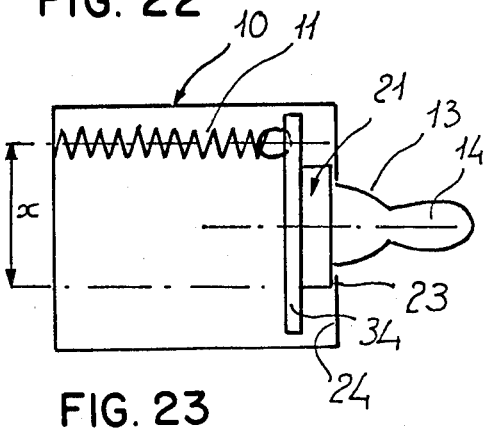
FIGS. 22 and 23 are schematic representations viewed laterally and from above of an alternative embodiment of the invention.
Figure 23:
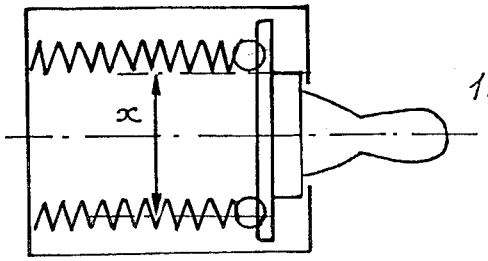

In the embodiments described until this point, the action of the springs 11 on the latching finger 13 was exerted by means of an intermediate and independent element, i.e., the pressure element 12. Nevertheless, this intermediate element need not necessarily be used. Thus, it is possible to replace the independent pressure element 12 by a pressure element integral with latching finger element 13 to obtain a similar effect. Thus, FIGS. 22 and 23 schematically illustrate a possible construction in axial cross-section and top planar views respectively. In this embodiment the base 21 of the finger 13 is integral with a pressure disk 34 on which two compression springs 11 press directly. These springs are symmetrical with respect to the vertical plane of the axis of the finger 13 (at rest) but are both situated clearly above the horizontal plane of this axis. One thus obtains under stress, between the support point of the shoulder 23 of the base of the finger 13 on the internal surface 24 of the container 10 and the plane of the axes of the springs 11, a lever arm x which is quite substantial, thus rendering the system very effective. The reasoning behind the respective positioning of each spring 11 in the case of a device having a finger 13 and a pressure element 12 likewise applies if one considers a stress in a vertical direction and in the lateral direction on the tip of nipple 14 of the finger 13. Under vertical stress the two springs 11 are compressed and under lateral stress a single spring 11 operates in practice. One thus obtains a ratio of approximately 2:1 between the respective release thresholds.

Figure 24:
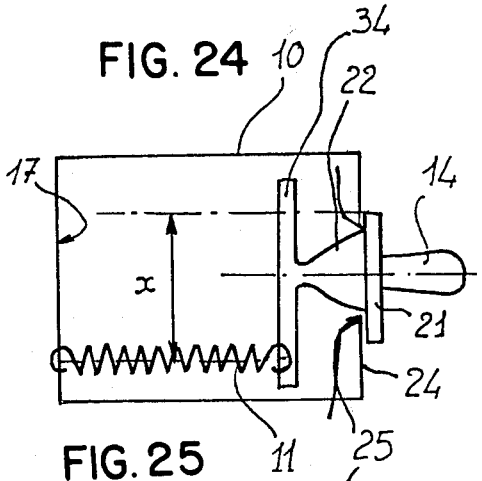
FIGS. 24 and 25 are lateral and top planar views of another alternative embodiment.
Figure 25:
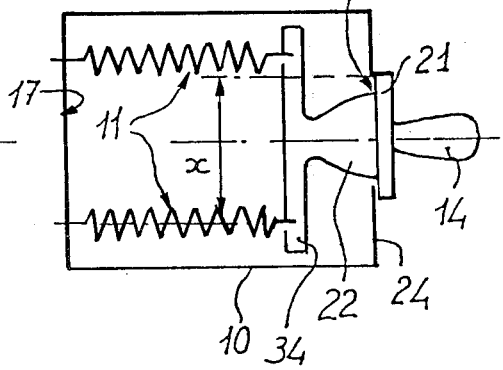

The device illustrated schematically in FIGS. 24 and 25 also relies upon a construction having no intermediate independent element 12 between the springs 11 and the finger 13. Yet, in this embodiment, compression springs are not used and instead traction springs are used. In this case the finger 13 is configured differently. The base 21 of the finger is now positioned between the nipple 14 and the body 22 (see FIGS. 3 and 4) and rests on the external surface of the wall 24 of the casing. The taper of the opening 25 for passage of the finger is reversed with respect to the embodiment shown in FIGS. 3 and 4, for example, and in the casing 10 the body 22 is integral with a disk 34 in which the springs 11 are anchored. These springs, otherwise anchored at the end 17 of the casing are preferably positioned symmetrically with respect to the vertical plane of the axis of the finger 13 at rest and below the horizontal plane of this axis. It may be easily seen that this construction, with the same lever arm x, is equivalent to and operates in the same fashion as, the previous embodiment so as to obtain the same result with the single difference that the forces exerted on the springs 11 are now tractional stresses and not compressional stresses.

From what has been said above, it may be seen that the device according to the invention well resolves the problem of release under the effect of a directional stress irrespective of the direction of the stress and makes it possible to obtain a ratio between the vertical and lateral forces of release at least approximating 2:1 and can be easily increased according to the modifications disclosed. Furthermore, the device can be utilized in conjunction with a wide variety of known bindings. Obviously, the initial tension of the springs can be adjusted by means which are, of themselves, well known.

Although the invention has been described with respect to particular means and devices, it is to be understood that the invention is not limited to the particulars disclosed but extends to cover all alternatives and equivalents falling within the scope of the claims.

What is claimed is:

1. A latching apparatus for use with a ski binding, said apparatus comprising:
   (a) a latching element adapted to be pivotable multidirectionally around more than one axis upon the application of an external force, said latching element comprising a shoulder;
   (b) elastic means adapted to bias said latching element and to allow for the multidirectional pivoting thereof;
   (c) support means adapted to support said shoulder with at least a portion of said latching element extending through said support means; and
   wherein said elastic means comprises at least two spring means, each of said spring means being positioned on opposite sides of a plane of symmetry extending through said latching apparatus.

2. The latching apparatus as defined by claim 1 wherein said elastic means is mounted in a casing, said casing comprising said support means as a first support means and a second support means for supporting one end of said spring means.

3. The latching apparatus as defined by claim 2 wherein said casing is mounted in a block adapted to be secured to said ski, whereby the terminal portion of said latching element is adapted to be seated in a retention notch associated with a ski boot mounted on said ski.

4. The latching apparatus as defined by claim 3 wherein said block is mounted on a ski.

5. The latching apparatus as defined by claim 3 in combination with said ski boot and wherein said retention notch is mounted directly on said ski boot.

6. The latching apparatus as defined by claim 5 wherein said block is mounted on said ski and said retention notch is positioned in a hollow provided in the base of said ski boot.

7. The latching apparatus as defined by claim 3 wherein said retention notch is formed of insertion ramps.

8. The latching apparatus as defined by claim 5 wherein said retention notch is positioned on a plate adapted to be secured to said ski boot.

9. The latching apparatus as defined by claim 5 wherein said retention notch is positioned on a head adapted to be mounted on said ski, said head being adapted to secure a boot to said ski.

10. The latching apparatus as defined by claim 9 wherein said head is adapted to be universally Cardan-mounted on said ski.

11. The latching apparatus as defined by claim 10 in combination with a ski, and wherein said head is universally Cardan-mounted on said ski.

12. The latching apparatus as defined by claim 2 wherein said latching element further comprises a base integral with said shoulder, and a disk, and wherein each of said spring means is positioned to act on said disk, and wherein said apparatus further comprises an intermediate portion between said base and said disk, said intermediate portion extending through said casing and having a tapering cross-section whereby the cross-section of said intermediate portion widens towards said base while being less than the cross-section of said base.

13. The latching apparatus as defined by claim 12 wherein said intermediate portion has a configuration described by the rotation of an arc of a circle in a radial plane having a radius equal to the diameter of said shoulder less the thickness of said shoulder around a point at the edge of the shoulder in the same radial plane.

14. The latching apparatus as defined by claim 12 wherein each of said spring means is a traction spring and wherein said support means is a first support means and a second support means which are positioned on opposite sides of said casing, whereby said base is held against said first support means by means of said traction springs.

15. The latching apparatus as defined by claim 14 wherein said first support means is an end wall of said casing, and wherein said intermediate portion extends through a hole in said end wall, said intermediate portion increasing to a cross-section equal to that of said hole in said end wall, said hole having a tapering cross-section which increases towards the exterior of said casing.

16. The latching apparatus as defined by claim 15 wherein the longitudinal axis of said traction springs lies in a plane positioned beneath the horizontal plane of the horizontal axis of the latching element when said base is held by said traction springs against said end wall.

17. The latching apparatus as defined by claim 16 further comprising a terminal portion mounted on said base, said terminal portion being adapted to seat in a retention notch.

18. The latching apparatus as defined by claim 17 wherein said base and shoulder are positioned on the exterior of said casing.

19. The latching apparatus as defined by claim 2 wherein said latching element ends in a U-shaped element integrally associated with a head adapted to secure said boot to said ski.

20. The latching apparatus as defined by claim 19 wherein said head is integrally secured to said U-shaped element by screw means allowing for the elevational adjustment of said head relative to said ski.

21. The latching apparatus as defined by claim 20 in combination with a ski, and wherein said casing is mounted on said ski.

22. The latching apparatus as defined by claim 2 wherein each of said spring means is a compression spring.

23. The latching apparatus as defined by claim 22 wherein said support means is a first support means and said first support means and a second support means are positioned on opposite sides of said casing.

24. The latching apparatus as defined by claim 23 wherein said latching element is a finger having a generally nipple shaped configuration.

25. The latching apparatus as defined by claim 23 wherein said latching element further comprises a base comprising said shoulder, and a disk integrally mounted beneath said base, and wherein each of said compression springs is positioned to exert pressure directly on said disk.

26. The latching apparatus as defined by claim 25 wherein said compression springs are positioned in a plane positioned above the horizontal plane of the longitudinal axis of the latching element.

27. The latching apparatus as defined by claim 26 wherein said base and shoulder are positioned on the interior of said casing.

28. The latching apparatus as defined by claim 1 further comprising an axially movable and pivotable pressure element, which is movable relative to said latching element, positioned between said spring means and said latching element, whereby said spring means press said pressure element against said latching element.

29. The latching apparatus as defined by claim 28 wherein said latching element comprises a base section beneath said shoulder and wherein said pressure element is adapted to contact said base and to pivot relative to said base.

30. The latching apparatus as defined by claim 29 wherein said pressure element comprises at least one pressure projection and said base comprises a section adapted to concentrate with said pressure projection.

31. The latching apparatus as defined by claim 30 wherein said base section comprises a socket configured to receive the tip of said pressure projection.

32. The latching apparatus as defined by claim 31 wherein the tip of said pressure projection is substantially hemispherical and said socket of said base section has a substantially hemispherical recess.

33. The latching apparatus as defined by claim 30 wherein said pressure projection has a generally parallelpipedic cross-section and ends in at least one semicylindrically shaped tip having a substantially vertical longitudinal axis.

34. The latching apparatus as defined by claim 33 comprising two of said semicylindrically shaped tips and said base section comprising two sockets to seat each of said tips.

35. The latching apparatus as defined by claim 23 wherein said pressure element further comprises a positioning bead on the surface of the tip of said pressure projection and said base section comprises a bead socket configured whereby said bead seats within said socket such that said latching element pivots radially along the semicylindrically shaped tip of the pressure projection of said pressure element in response to a lateral force and said latching element pivots along an upper edge of the tip of said pressure projection in response to a vertical force.

36. The latching apparatus as defined by claim 30 wherein said pressure projection has a generally parallelpipedic cross-section and ends in at least one semicylindrically shaped tip having a substantially horizontal longitudinal axis.

37. The latching apparatus as defined by claim 30 wherein said pressure projection has a flattened tip.

38. A ski in combination with the latching assembly as defined by claim 1.

39. The latching apparatus as defined by claim 1 wherein said elastic means is adapted to exert a differential pivoting threshold.

40. The latching apparatus as defined by claim 39 wherein the ratio of the vertical pivoting threshold to the lateral pivoting threshold is at least 2:1.

41. The latching apparatus as defined by any one of claims 1, 12, or 25 wherein said latching element has a surface of revolution formed by rotation of a generatrix.

42. The latching apparatus as defined by claim 1 wherein said elastic means comprises at least three spring means.

43. The latching apparatus as defined by claim 1 wherein said latching element further comprises a base, a tip, and an intermediate section.

44. The latching apparatus as defined by claim 1 further comprises a base and an eliptically shaped tip integral with said base.

* * * * *

UNITED STATES PATENT AND TRADEMARK OFFICE

CERTIFICATE OF CORRECTION

PATENT NO. : 4,418,937

DATED : December 6, 1983

INVENTOR(S) : Georges P. J. SALOMON

It is certified that error appears in the above-identified patent and that said Letters Patent is hereby corrected as shown below:

In Column 3, line 10, delete "of" and substitute ---and--- therefor.

In Column 4, line 23, delete "line" and substitute ---lines--- therefor.

In Column 4, line 37, delete "illustrates" and substitute ---illustrate--- therefor.

In Column 6, line 24, "deivce" should read ---device---.

In Column 6, line 36, delete "the" and substitute ---this--- therefor.

In Column 11, line 9, delete "Cardan-".

In Column 11, line 13, delete "Cardan-".

In Column 14, line 11, delete "comprises" and substitute ---comprising--- therefor.

Signed and Sealed this

*Seventeenth* Day of *July 1984*

[SEAL]

*Attest:*

GERALD J. MOSSINGHOFF

*Attesting Officer*

*Commissioner of Patents and Trademarks*